US006371225B1

(12) United States Patent
Overstreet et al.

(10) Patent No.: US 6,371,225 B1
(45) Date of Patent: Apr. 16, 2002

(54) DRILL BIT AND SURFACE TREATMENT FOR TUNGSTEN CARBIDE INSERT

(75) Inventors: James L. Overstreet, Webster; Anil Kumar, Sugar Land, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/548,867

(22) Filed: Apr. 13, 2000

Related U.S. Application Data

(60) Provisional application No. 60/129,718, filed on Apr. 16, 1999.

(51) Int. Cl.[7] ..... E21B 10/50

(52) U.S. Cl. ..... 175/374; 175/428

(58) Field of Search ..... 175/426, 428, 175/432, 374, 412, 413, 331, 341; 76/108.2; 51/295

(56) References Cited

U.S. PATENT DOCUMENTS 4,211,508 A 7/1980 Dill et al.
4,593,776 A * 6/1986 Salesky et al. ..... 175/375
5,355,750 A 10/1994 Scott et al. ..... 76/108.2
5,370,195 A * 12/1994 Keshavan et al. ..... 175/420.2
5,379,853 A 1/1995 Lockwood et al.
5,630,479 A 5/1997 Dennis
6,170,583 B1 * 1/2001 Boyce ..... 175/426

FOREIGN PATENT DOCUMENTS

GB 2282833 A 4/1995 ..... E21B/10/46

* cited by examiner

*Primary Examiner*—David Bagnell
*Assistant Examiner*—Zakiya Walker
(74) *Attorney, Agent, or Firm*—Bracewell & Patterson, L.L.P.

(57) ABSTRACT

A drill bit insert has a cylindrical barrel, a bevel on one end, an interface therebetween, and a cutting tip opposite the bevel. The bevel and interface contact the entrance to a hole in the drill bit and facilitate the transition of the barrel into the hole. A high quality surface finish on the bevel and interface enhance the durability and retention of the insert in the drill bit. The surface finish on the insert is produced by polishing it with a diamond lapping film. The insert is rotated between three rollers as the lapping film passes over its surface. One of the rollers and the film conform to the axial profile of the insert as each element rotates so that the interface, bevel, and barrel of the insert are simultaneously polished.

11 Claims, 8 Drawing Sheets

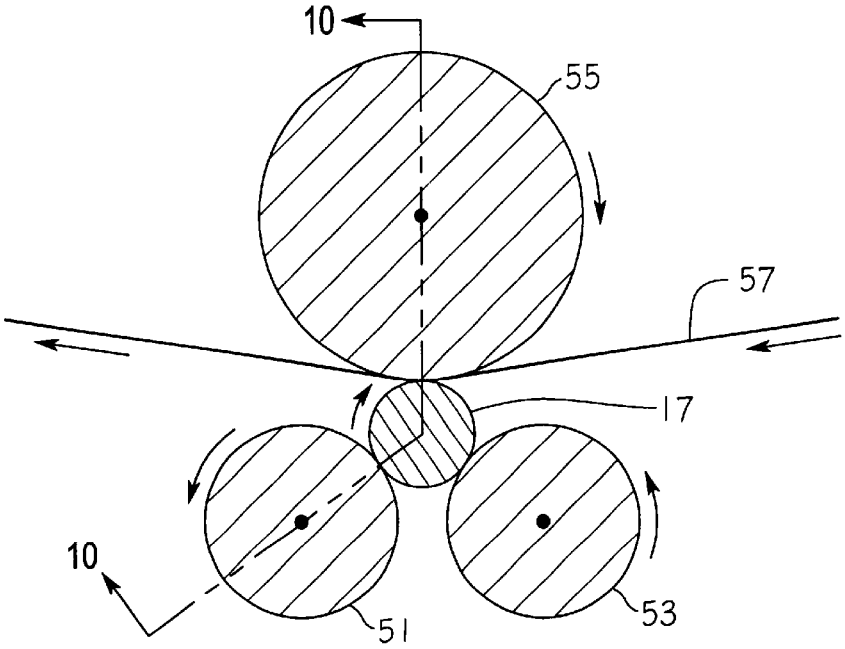
FIG. 9
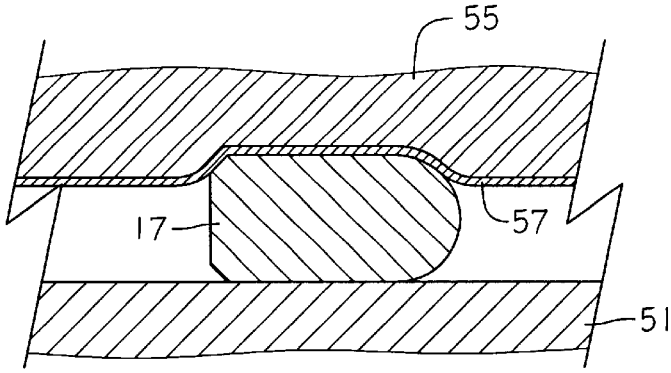
FIG. 10
FIG. 11
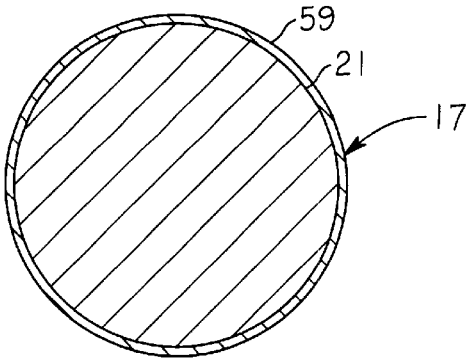

DRILL BIT AND SURFACE TREATMENT FOR TUNGSTEN CARBIDE INSERT

CROSS-REFERENCE TO RELATED APPLICATIONS

Applicant claims the benefit of provisional application Ser. No. 60/129,718, filed Apr. 16, 1999.

TECHNICAL FIELD

This invention relates in general to inserts for earth boring drill bits and in particular to a surface finish on drilling inserts used on the cones of the bits.

DESCRIPTION OF THE PRIOR ART

A common type of earth boring bit a rolling cone type. The bit has a plurality of cones, normally three, that rotate about their own axes as the bit body is rotated about its axis. Each cone has cutting elements on the exterior that gouge and scrape the borehole bottom. For harder formations, tungsten carbide inserts are pressed into mating holes in the cones. Each insert has a cylindrical base that fits with an interference in the cone body. A cutting tip, which may have various shapes, protrudes from the base.

Tungsten carbide inserts are formed by pressing and sintering tungsten carbide particles in a matrix such as cobalt. After removal from the die, the base of the insert must be ground to the precise size. Conventional systems and methods of grinding of cemented carbide parts, such as drilling inserts, leaves relatively deep, wide scratches in their surface finish. This is due in part to the grinding wheel having diamond particles that stick up above the predominant grinding plane formed by the supporting matrix material. During use, the relatively soft matrix material tends to erode away faster than the larger, harder diamond particles, thereby exposing the diamonds to rough up the surface of the inserts.

Inserts with roughened surfaces require far more insertion force during installation, and have lower retention and durability during drilling. In addition, an insert with a low quality surface finish increases wall shearing of the steel body of the cone in the hole, which also diminishes retention.

Although inserts can be polished to a smoother surface finish, conventional polishing techniques are limited to treating surfaces that are substantially parallel to the polishing device. For example, the base of a drilling insert typically has a cylindrical barrel that tapers to a bevel on one end to facilitate insertion into the drill bit. When the insert is polished by conventional techniques, only the surface finish of the barrel is improved; the bevel remains unpolished. Unfortunately, the surface finish of the bevel has a significant impact on the performance of the insert.

SUMMARY OF THE INVENTION

A drilling insert has a cylindrical barrel, a bevel on one end, an interface therebetween, and a cutting tip opposite the bevel. The insert is forced into a hole in a drill bit under high pressure in order to overcome an interference fit therebetween. While being pressed into the hole, the bevel and interface contact the entrance to the hole and facilitate the transition of the barrel into the hole. A high quality surface finish on the bevel and interface are critical for enhancing the durability and retention of the insert in the drill bit.

The surface finish on the insert may be produced by polishing it with a diamond lapping film. The insert is rotated between three rollers as the lapping film passes over its surfaces. One of the rollers and the film conform to the axial profile of the insert as each element rotates, so that the interface, bevel, and barrel of the insert are simultaneously polished. Other surface finishing techniques, such as tumbling, also may be used to produce the desired surface finish. After polishing, a coating may be applied to the insert to retard corrosion. After coating, the insert is preferably polished again by the diamond lapping film process.

BRIEF DESCRIPTION OF DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

FIG. 9 is a schematic, sectional side view of an apparatus for creating a desired surface finish on the insert of FIG. 2.

FIG. 10 is an enlarged sectional view of the apparatus and insert of FIG. 9 taken along the line 10—10 of FIG. 9.

FIG. 11 is a sectional view of the insert of FIG. 2, taken along the line 11—11 of FIG. 2.

BEST MODE FOR CARRYING OUT THE INVENTION

Figure 1:
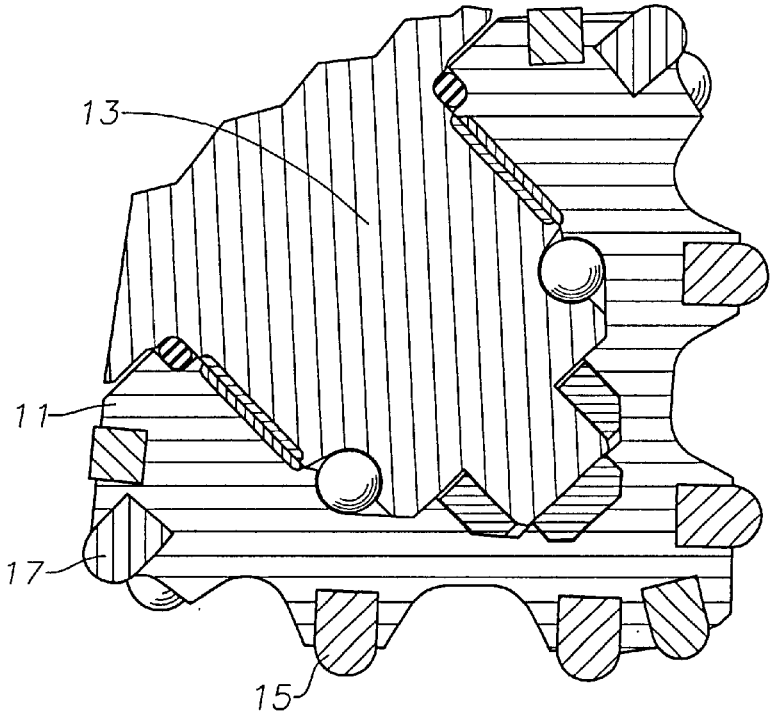
FIG. 1 is a fragmentary sectional view of a rolling cone with inserts used as earth disintegrating teeth.

Referring to FIG. 1, a conventional rolling cone 11 supported on a bearing pin 13 of a rotary drill bit is shown. Cone 11 has a plurality of blind holes 15, each of which receives and secures a metal drilling insert 17 with an interference fit. The preferred metallurgical composition of insert 17 is a tungsten carbide—cobalt/nickel base insert substrate. Insert 17 is formed in a conventional sintering process.

Figure 2:
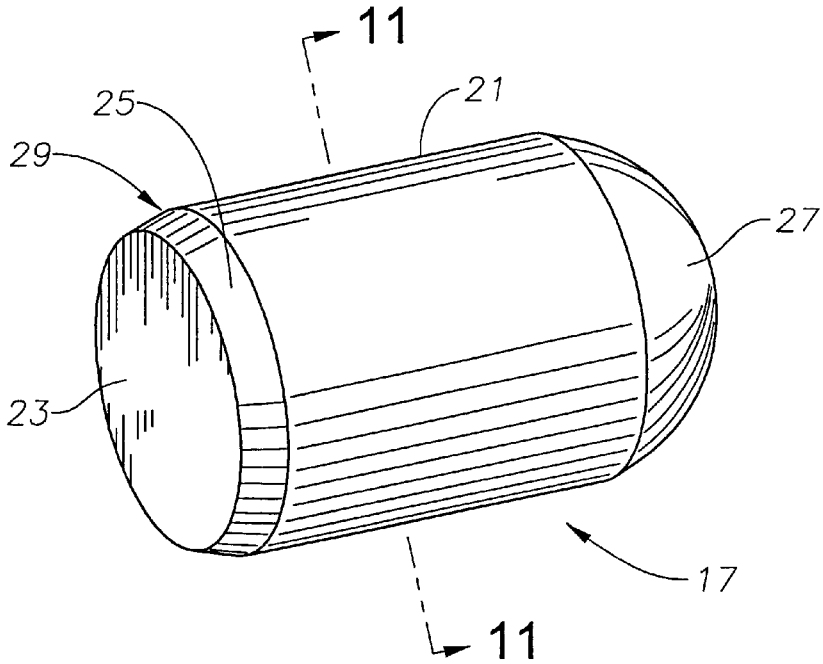
FIG. 2 is an enlarged isometric view of one of the inserts of FIG. 1 and is constructed in accordance with the invention.

As shown in FIG. 2, insert 17 is a stud with a cylindrical wall surface or barrel 21, a perpendicular end 23 with a bevel 25, and a cutting tip end 27, which is hemispherical in the embodiment shown. Cutting end 27 may have other configurations, such as conical, chisel or ovoid. Insert 17 also has a small annular interface 29 with a radius between barrel 21 and bevel 25.

The outer diameter of barrel 21 is greater than the inner diameter of hole 15, creating an interference fit to retain insert 17 within hole 15. Inserts 17 are forced into holes 15 under high force in order to overcome the interference fit therebetween. While being pressed into hole 15, bevel 25 will contact the entrance to hole 15. Bevel 25 and interface 29 facilitate the transition of barrel 21 into hole 15 during insertion. The surface finish on bevel 25 and on interface 29 are critical for enhancing the retention of inserts 17 and their durability. In particular, the improved surface finish on interface 29 minimizes or eliminates wall shearing of the steel body of cone 11 in hole 15 for improved retention.

One method for producing the surface finish on inserts 17 in accordance with the invention is illustrated in FIGS. 9 and 10. After grinding, barrel 21, bevel 25 and interface 29 are polished with a diamond lapping film 57. Insert 17 is shown between two drive rollers 51, 53 and a top roller 55. Rollers 51, 53, 55 rotate insert 17 about its axis in a first direction. Top roller 55 is formed from a compliant blastomeric material such that it conforms to the axial profile of insert 17 (FIG. 10) without touching rollers 51, 53. This ability to conform is critical to polishing interface 29 and bevel 25 of insert 17. Lapping film 57 is moved between insert 17 and top roller 55 in a second direction that is counter to the direction of rotation of insert 17. A cooling liquid is delivered over insert 17 during this process. Film 57 makes one pass by insert 17 and is constantly renewed on a film feeding system. As shown in FIG. 10, film 57 deflects and conforms to the contours of bevel 25 and interface 29 under top roller 55. The preferred film 57 is manufactured by 3M Company, St. Paul, Minn. Various surface finishes for film 57 are available, but 45 micron film is preferred. The equipment for performing this diamond film lapping process is manufactured by Grinding Equipment & Machining Co., Inc., Youngstown, Ohio. Other surface finishing techniques, such as tumbling, also may be used to produce the desired surface finish on bevel 25 and interface 29.

After the lapping process or other surface finishing techniques, a smooth, hard metal coating 59 (FIG. 11) is preferably placed on insert 17. Coating 59 is very thin, preferably about 0.75 micron, thus is exaggerated in thickness in FIG. 11. The coating range may be from 0.1 micron to several thousandths of an inch thick. Insert 17 is coated particularly on barrel 21, bevel 25 and interface 29, and may also be on cutting end 27. The coating is done by a conventional process, such as by chemical vapor deposition (CVD) or pressure vapor deposition (PVD). The preferred method is by CVD, which results in an omni-direction coating and occurs at a temperature of about 1100 degrees C. The PVD process is at a lower temperature than the CVD process, however deposits by line-of-site, rather than omni-directional. The prior polishing by the diamond lapping film helps retain coating 59. The hard, abrasion-resistant coating 59 may be tic, tin, TAC, A12O3, Tic, B4C, or any combination of these coatings, or, in general, nitrites and carbides of the IVa, Va and VIa groups of the periodic table. The elements of these groups are titanium, zirconium, hafnium, vanadium, niobium, tantalum, chromium, molybdenum, and tungsten. Coating 59 also may be single or multi-layered. After coating, insert 17 is preferably polished again by the diamond lapping film process described above.

Figure 4:
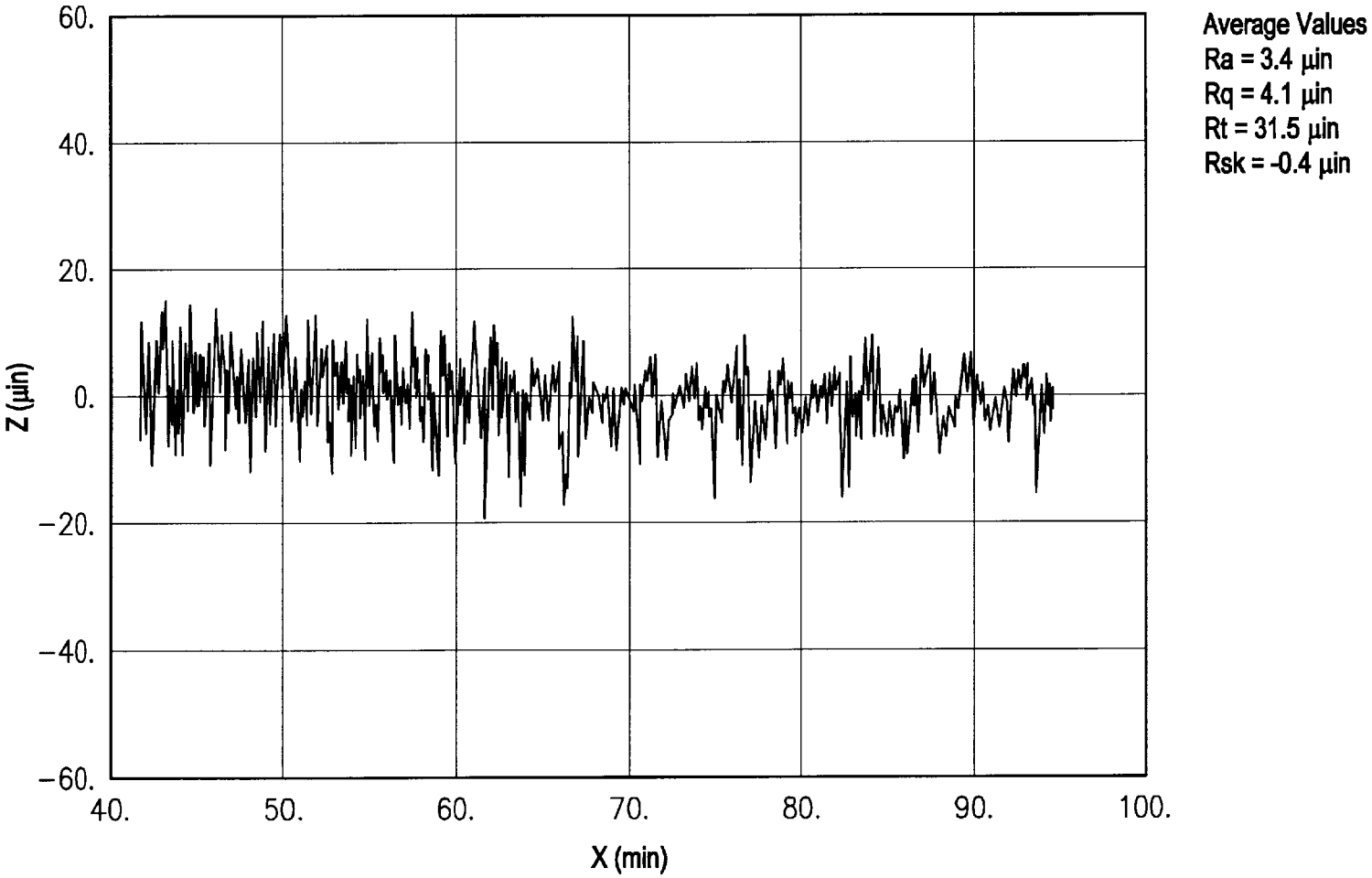
FIG. 4 is a graph of a barrel to bevel transition or radius for the insert of FIG. 2.

Referring now to FIG. 4, a plot of the surface finish of insert 17 is shown after being polished by the diamond lapping process. The insert 17 measured in FIGS. 4–7 has not been coated as described above. In FIG. 4, the horizontal axis depicts displacement along the surface of the insert (in thousandths of an inch), and the vertical axis depicts variations in its surface finish (in microns). The vertical scale is exaggerated to about 500:1 to better illustrate the surface roughness. The arithmetic mean of the absolute value of the deviations from the mean line (Ra) is 3.4 microns and preferably is not greater than about 5 microns on barrel 21 or bevel 25. The root mean square (rms) value (Rq) corresponding to Ra is 4.1 microns. The maximum peak to valley height (Rt) is 31.5 microns and preferably should be no more than about 50 microns on barrel 21 or bevel 25. Finally, the skewness (Rsk), or symmetry of the amplitude distribution curve about the mean line, is −0.4.

Figure 3:
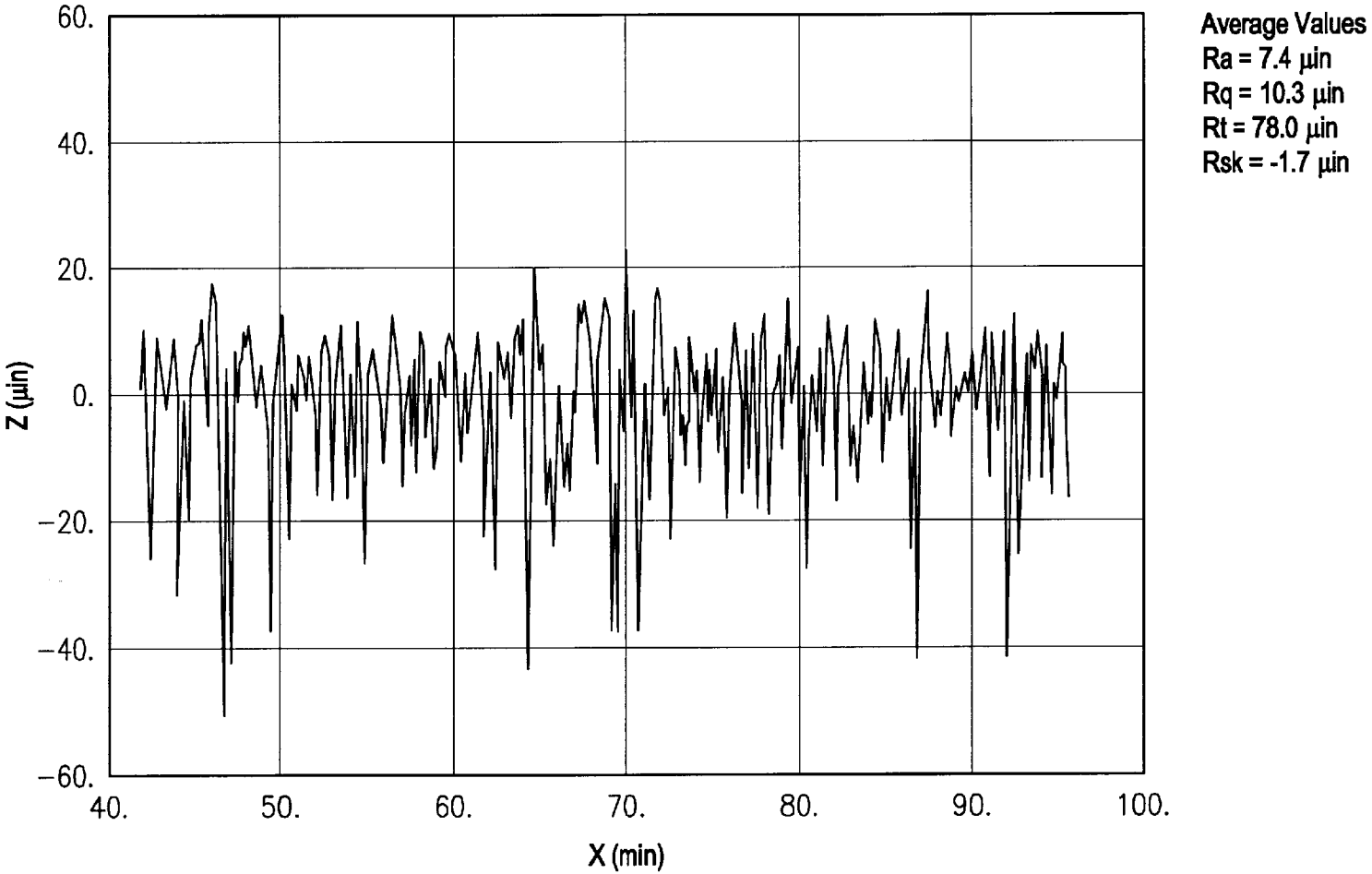
FIG. 3 (PRIOR ART)
FIG. 3 is a graph of a barrel to bevel transition or radius for a prior art insert.

In FIG. 3, a plot of the surface finish of a prior art insert is shown for comparison. FIG. 3 has the same scales as FIG. 4, and illustrates that the prior art insert has much greater irregularities with significantly higher values, including: Ra=7.4 microns, Rq=10.3 microns, Rt=78.0 microns, and Rsk=−1.7. The prior art insert was ground and tumbled, but does not have a surface coating nor was it polished by a diamond lapping film.

Figure 5:
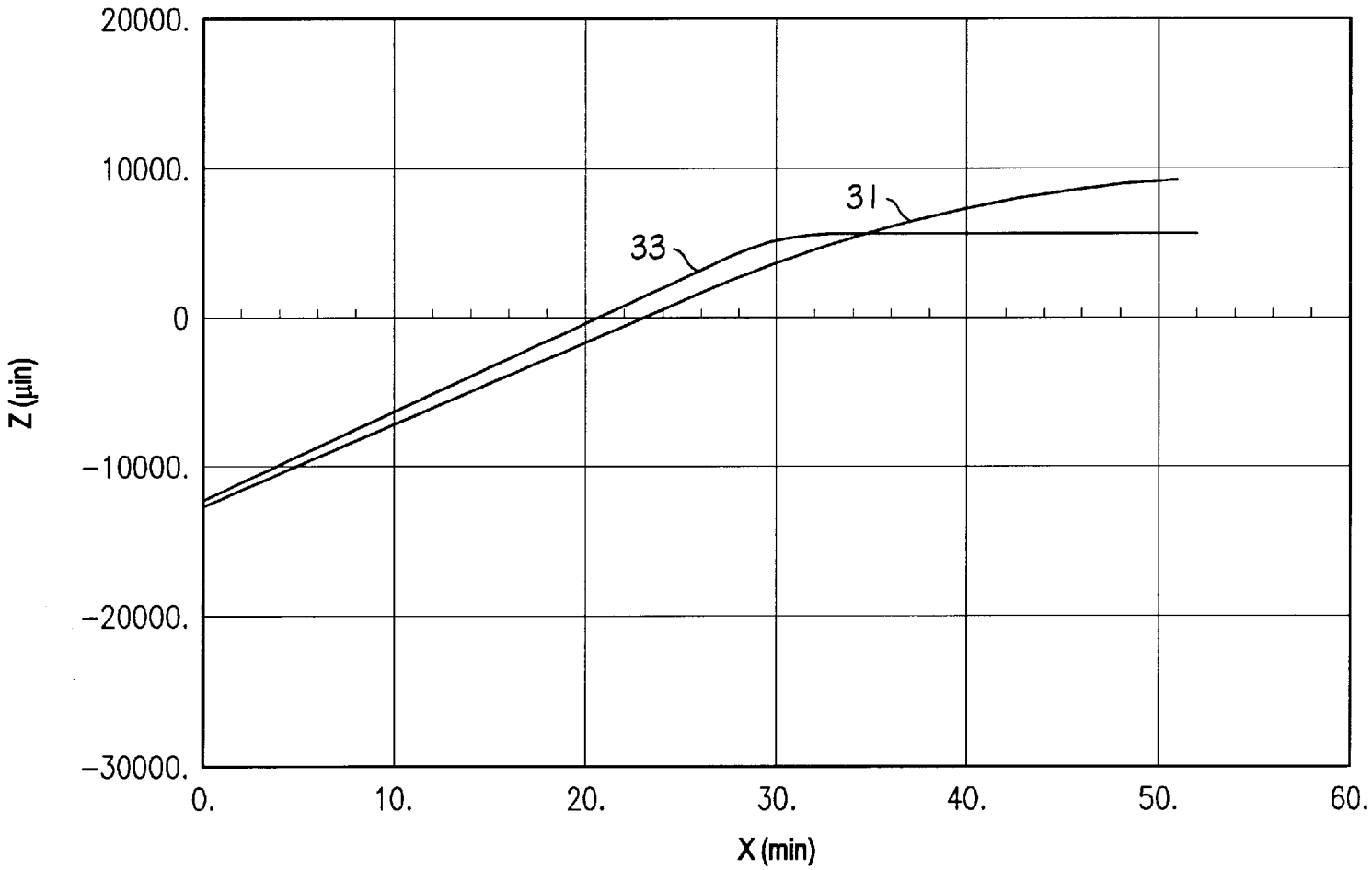
FIG. 5 is a graphical representation of the interface surface between the barrel and the bevel of a prior art insert and the insert of FIG. 2.

FIG. 5 shows a magnification of the surface profile of insert 17 (plot 31) and the prior art insert (plot 33). The vertical axis depicts the change in the slope of the surface of the inserts (in microns), and the horizontal axis depicts displacement along the surfaces of the inserts (in thousandths of an inch). Each plot 31, 33 is limited to the transition from barrel 21 to interface 29 to bevel 25. The surface finish of insert 17 gives plot 31 a much more gradual slope than that of plot 33. The smooth transitional surface of insert 17 reduces the compact hole wall damage during press-in, thus improving compact retention.

The numeric values associated with plots 31, 33 are as follows:

| | Insert 17 | Prior art insert |
|---|---|---|
| Barrel Ra (microns) | 3.4 | 7.4 |
| Bevel Ra (microns) | 4.5 | 13.9 |

Figure 6:
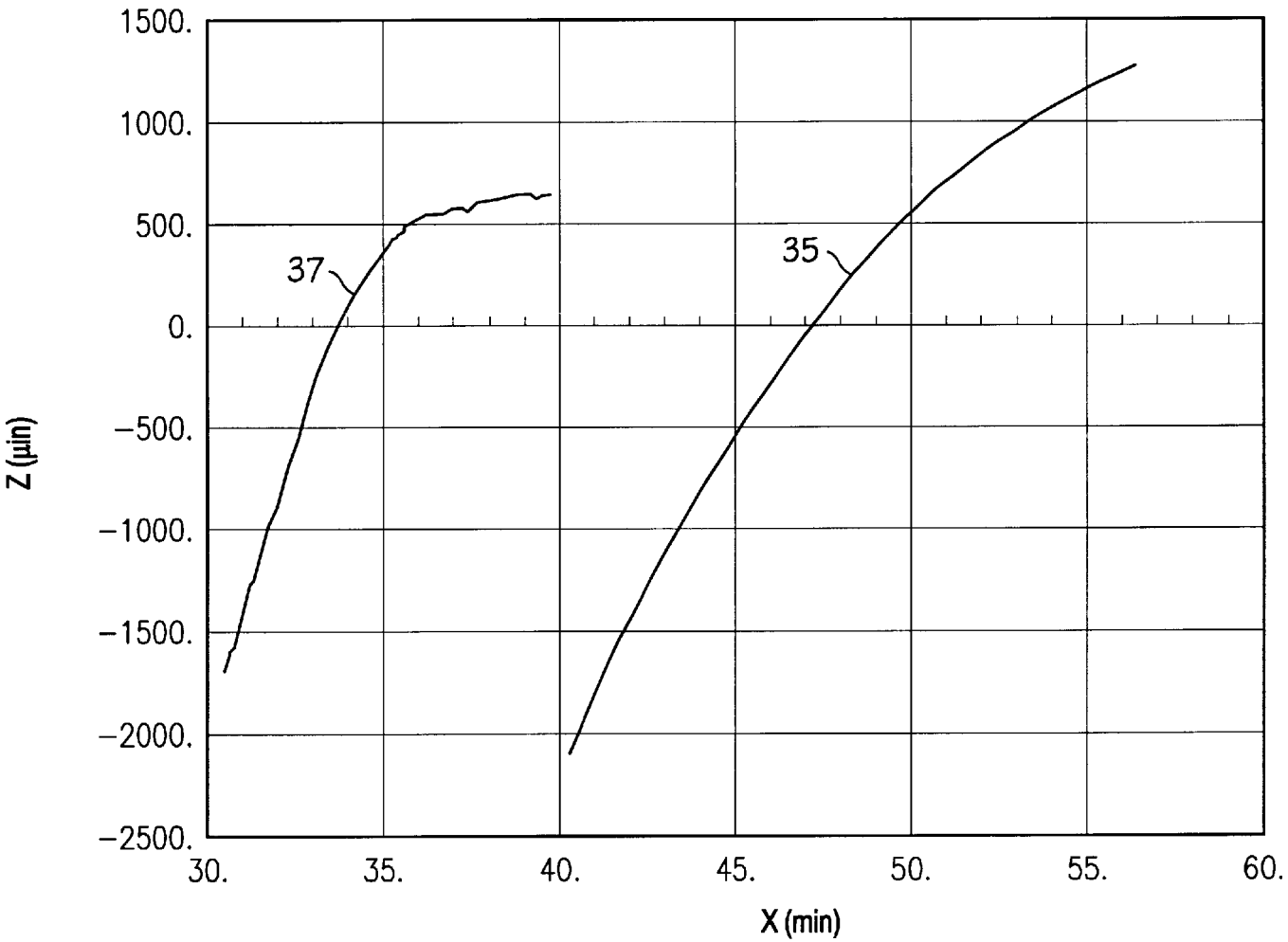
FIG. 6 is a graphical representation of the graph of FIG. 5, but in a reduced magnification.

Similarly, in FIG. 6, a reduced magnification of the interfaces 29 of insert 17 (plot 35) and the prior art insert (plot 37) are shown. Again, the slope of plot 35 is much smoother and more gradual than that of plot 37.

Figure 7:
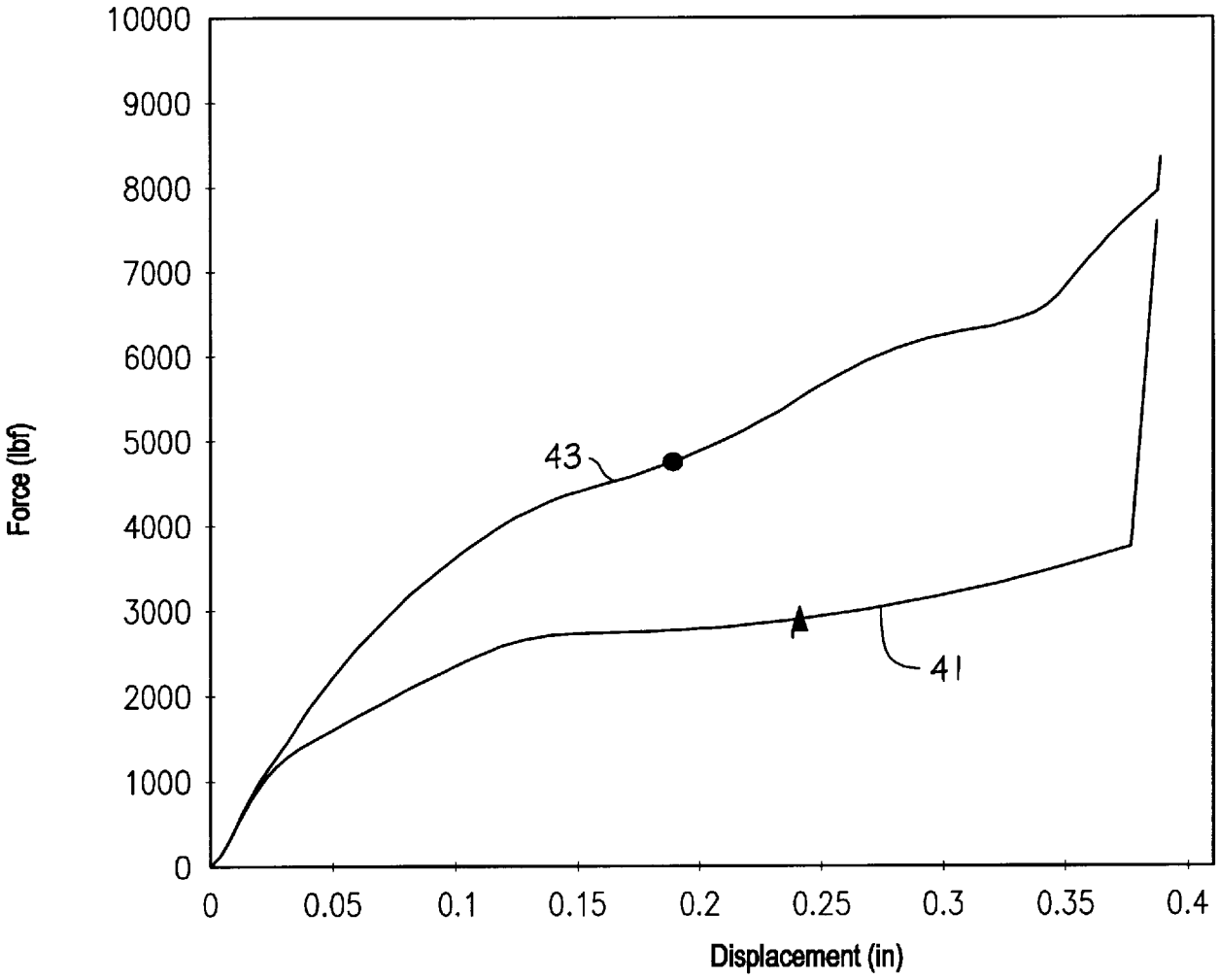
FIG. 7 is a graph of insertion force versus displacement for the insert of FIG. 2 and the prior art insert.
Figure 8:
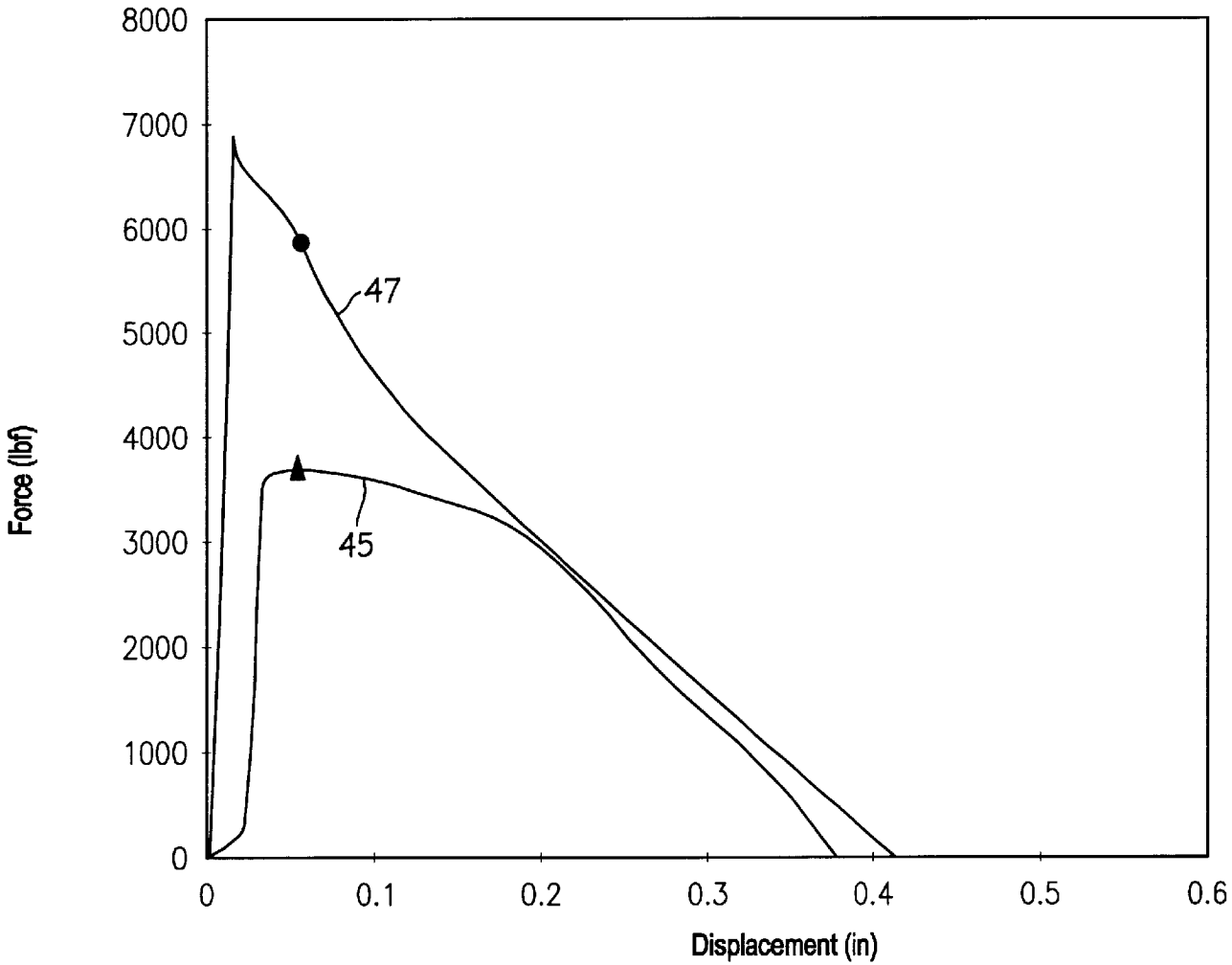
FIG. 8 is a graph of push-out or removal force versus displacement for the insert of FIG. 2 and the prior art insert.

FIG. 7 illustrates yet another advantage of the invention. Plots 41, 43 depict the insertion force (vertical axis, lbf) required to push insert 17 and the prior art insert, respectively, into holes 15 along their displacement (horizontal axis, inches). The surface finish of bevel 25 and interface 29 is much smoother than that of prior art inserts and requires far less insertion force. This indicates that less shearing of metal in hole 15 occurs. In FIG. 8, plots 45, 47 show the amount of push-out force required to push insert 17 and the prior art insert, respectively, out of holes 15. With the prior art insert (plot 47), the initial force required to cause movement is higher than that for insert 17 (plot 45), but diminishes at a greater rate once the insert starts moving. This indicates that cone metal has been sheared in hole 15. Thus, once the insert has moved slightly, the diameter of hole 15 is larger due to the sheared metal. The enlarged diameter portion provides less compressive force against the insert along the length of hole 15. Less compressive force allows slight rocking movement to occur during operation at high forces. This can result in breakage of the insert or loss of the insert from the hole. The slope of plot 45 indicates that the metal in hole 15 was not sheared and that the compressive force remains uniform along the length of the insert.

The invention has several advantages. The surface finish of the bevel and interface is much smoother than that of prior art inserts and requires far less insertion force. The bevel and interface facilitate the transition of the barrel into its mounting hole during insertion. The surface finish on the bevel and interface are also critical for enhancing the retention of the inserts and their durability. In particular, the improved surface finish on the interface minimizes or eliminates wall shearing of the steel body of the cone in the hole for improved retention.

In addition, the dense, uniform coating forms a good metallurgical bond with the substrate binder, resulting in improved abrasion resistance and surface finish. The coating (s) provide improved corrosion resistance and retention due to lower reactivity with drilling fluids, and a lower coefficient of friction. The coating may act as a diffusion barrier between the substrate and cone material. The low friction significantly reduces the compact hole wall damage during press-in, thus improving compact retention.

While the invention has been shown or described in only some of its forms, it should be apparent to those skilled in the art that it is not so limited, but is susceptible to various changes without departing from the scope of the invention.

We claim:

1. A drill bit, comprising:

a body;

a plurality of blind holes formed in the body;

an insert mounted in each of the blind holes, the insert having a cylindrical barrel, a base end on one end of the barrel, and a cutting tip end opposite the base end, wherein an interference fit is provided between each of the barrels and the each of the blind holes;

a bevel on the insert extending between the cylindrical barrel and the base end, defining an interface at an intersection between the bevel and the barrel, wherein the barrel, the cutting tip and the bevel are formed of a support metal of tungsten carbide;

a ground and polished surface formed on the support metal of the barrel, the bevel, and the interface; and a hard metal coating formed on the ground and polished surface of the support metal of the cylindrical barrel, the bevel, and the interface.

2. The drill bit of claim 1 wherein the coating has a thickness in the range of 0.1 to 3000 microns.

3. The drill bit of claim 1 wherein the coating is selected from a group consisting of nitrites and carbides of titanium, zirconium, hafnium, vanadium, niobium, tantalum, chromium, molybdenum, and tungsten.

4. The drill bit of claim 1 wherein the coating also extends over the cutting end.

5. A drill bit insert adapted to be installed in a hole in a drill bit and retained therein via interference fit, comprising:

a cylindrical barrel;

a base end on one end of the barrel, and a cutting tip end opposite the base end;

a bevel on the insert extending between the cylindrical barrel and the base end, defining an interface at an intersection between the bevel and the barrel;

a hard metal coating on the cylindrical barrel, the bevel, and the interface; and wherein the interface between the bevel and the barrel has deviations that deviate from a mean line, such that an arithmetic mean of an absolute value of the deviations from the mean line (Ra) is not greater than about five microns.

6. A drill bit insert adapted to be installed in a hole in a drill bit and retained therein via interference fit, comprising:

a cylindrical barrel;

a base end on one end of the barrel, and a cutting tip end opposite the base end;

a bevel on the insert extending between the cylindrical barrel and the base end, defining an interface at an intersection between the bevel and the barrel;

a hard metal coating on the cylindrical barrel, the bevel, and the interface; and wherein the interface between the bevel and the barrel has deviations that deviate from a mean line, such that a peak to valley height is no greater than about 50 microns.

7. A drill bit, comprising in combination:

a body;

a plurality of blind holes formed in the body;

an insert mounted in each of the blind holes, the insert having a cylindrical barrel, a base end, and a cutting tip end opposite the base end, wherein an interference fit is provided between each of the barrels and each of the blind holes;

a bevel on the insert located between the cylindrical barrel and the base end;

an annular, radiused interface on the insert spanning the bevel and the cylindrical barrel, wherein the barrel, the bevel, the interface and the cutting tip are formed on a support metal of tungsten carbide, and the barrel, the bevel, and the interface have ground and polished metal surfaces; and a coating applied by chemical vapor deposition on the ground and polished metal surfaces of the cylindrical barrel, the bevel, and the interface.

8. The drill bit of claim 7 wherein the coating has a thickness in the range of 0.1 to 3000 microns.

9. A drill bit cone, comprising in combination:

a body;

a plurality of blind holes formed in the body;

a tungsten carbide insert mounted in each of the blind holes, the insert having a cylindrical barrel, a base end, and a cutting tip end opposite the base end, wherein an interference fit is provided between each of the barrels and each of the blind holes;

a bevel on the insert located between the cylindrical barrel and the base end;

an annular, radiused interface on the insert spanning the bevel and the cylindrical barrel;

a coating applied by chemical vapor deposition on the cylindrical barrel, the bevel, and the interface; and wherein the coating on the interface has deviations that deviate from a mean line, such that an arithmetic mean of an absolute value of the deviations from the mean line (Ra) is no greater than approximately five microns.

10. A drill bit cone, comprising in combination:

a body;

a plurality of blind holes formed in the body;

a tungsten carbide insert mounted in each of the blind holes, the insert having a cylindrical barrel, a base end, and a cutting tip end opposite the base end, wherein an interference fit is provided between each of the barrels and each of the blind holes;

a bevel on the insert located between the cylindrical barrel and the base end;

an annular, radiused interface on the insert spanning the bevel and the cylindrical barrel;

a coating applied by chemical vapor deposition on the cylindrical barrel, the bevel, and the interface; and wherein the coating is selected from a group consisting of nitrites and carbides of titanium, zirconium, hafnium, vanadium, niobium, tantalum, chromium, molybdenum, and tungsten.

11. A drill bit cone, comprising in combination:

a body;

a plurality of blind holes formed in the body;

a tungsten carbide insert mounted in each of the blind holes, the insert having a cylindrical barrel, a base end, and a cutting tip end opposite the base end, wherein an interference fit is provided between each of the barrels and each of the blind holes;

a bevel on the insert located between the cylindrical barrel and the base end;

an annular, radiused interface on the insert spanning the bevel and the cylindrical barrel;

a coating applied by chemical vapor deposition on the cylindrical barrel, the bevel, and the interface; and wherein the coating on the interface between the bevel and the barrel has deviations that deviate from a mean line, such that a peak to valley height is no greater than about 50 microns.

* * * * *

UNITED STATES PATENT AND TRADEMARK OFFICE

CERTIFICATE OF CORRECTION

PATENT NO. : 6,371,225 B1
DATED : April 16, 2002
INVENTOR(S) : James L. Overstreet et al.

It is certified that error appears in the above-identified patent and that said Letters Patent is hereby corrected as shown below:

Column 1,
Line 16, after "bit" insert -- is --

Column 3,
Line 19, delete "blastomeric" and insert therefor -- elastomeric --

Signed and Sealed this

Thirtieth Day of July, 2002

*Attest:*

*Attesting Officer*

JAMES E. ROGAN
*Director of the United States Patent and Trademark Office*